US005876236A

United States Patent [19]

Chen

[11] Patent Number: 5,876,236

[45] Date of Patent: Mar. 2, 1999

[54] LAMP SOCKET WITH A WATER SEALING AND ELECTRIC LEAKAGE PREVENTING STRUCTURE

[76] Inventor: Ming-Hsiung Chen, 7F, No. 16, Alley 3, Lane 227, Nung-An St., Taipei, Taiwan

[21] Appl. No.: 802,787

[22] Filed: Feb. 18, 1997

Related U.S. Application Data

[63] Continuation-in-part of Ser. No. 638,495, Apr. 26, 1996, Pat. No. 5,743,757, which is a continuation-in-part of Ser. No. 546,820, Oct. 23, 1995, Pat. No. 5,702,267.

[51] Int. Cl.[6] ..... H01R 4/24

[52] U.S. Cl. ..... 439/419; 439/280

[58] Field of Search ..... 439/280, 417, 439/418, 419, 602, 605

[56] References Cited

U.S. PATENT DOCUMENTS

| | | | |
|---|---|---|---|
| 1,710,373 | 4/1929 | Moore . | |
| 1,738,341 | 12/1929 | Wulle . | |
| 2,170,317 | 8/1939 | Bussman | 337/216 |
| 2,296,717 | 4/1942 | Kridler | 439/592 |
| 2,308,016 | 1/1943 | Mihalyi . | |
| 2,570,751 | 10/1951 | Benander . | |
| 2,636,069 | 4/1953 | Gilbert | 439/419 |
| 2,800,635 | 7/1957 | Christenbery . | |
| 3,128,141 | 4/1964 | Krupp et al. | 439/419 |
| 3,130,921 | 4/1964 | Morgan . | |
| 3,151,926 | 10/1964 | Schick et al. . | |
| 3,251,023 | 5/1966 | Schick | 439/414 |
| 3,372,362 | 3/1968 | Schick | 439/419 |
| 3,601,767 | 8/1971 | Eckles | 439/419 |
| 3,660,801 | 5/1972 | Paulfus | 439/419 |
| 3,716,818 | 2/1973 | Finkelstein . | |
| 3,936,122 | 2/1976 | Hagelberg . | |
| 4,222,623 | 9/1980 | Hultberg . | |
| 4,382,654 | 5/1983 | Schick . | |
| 4,653,829 | 3/1987 | LaMont . | |
| 4,660,916 | 4/1987 | Williams, Jr. . | |
| 5,051,877 | 9/1991 | Liao | 439/419 |
| 5,109,324 | 4/1992 | Ahroni . | |
| 5,228,774 | 7/1993 | Liao | 439/419 |
| 5,241,746 | 9/1993 | Herzog et al. . | |
| 5,339,232 | 8/1994 | Lin | 439/505 |
| 5,366,386 | 11/1994 | Liao | 439/419 |
| 5,380,215 | 1/1995 | Huang . | |
| 5,421,742 | 6/1995 | Huang | 439/419 |
| 5,439,389 | 8/1995 | Cheng et al. | 439/419 |
| 5,446,640 | 8/1995 | Lin . | |
| 5,474,467 | 12/1995 | Chen | 439/419 |
| 5,492,483 | 2/1996 | Cheng et al. | 439/339 |
| 5,531,609 | 7/1996 | Cheng et al. | 439/340 |
| 5,562,481 | 10/1996 | Myson | 439/419 |
| 5,634,812 | 6/1997 | Chen | 439/419 |
| 5,643,006 | 7/1997 | Wang et al. | 439/419 |
| 5,660,560 | 8/1997 | Cheng et al. | 439/419 |

FOREIGN PATENT DOCUMENTS

| | | |
|---|---|---|
| 119539 | 10/1918 | United Kingdom . |
| 2253045 | 8/1992 | United Kingdom . |

*Primary Examiner*—Paula Bradley
*Assistant Examiner*—Tho Dac Ta
*Attorney, Agent, or Firm*—Ladas & Parry

[57] ABSTRACT

A lamp socket with a water sealing and electric leakage preventing structure, including a channel-like rubber gasket fitted into a top wire groove in a socket body to hold an electric wire and having two slots for the passing of a positive metal contact plate and a negative metal contact plate of the socket body, a rubber cover pad covered on the rubber gasket over the electric wire and compressed against the electric wire and the rubber gasket by a socket cap being fastened to the socket body to seal the periphery of the electric wire and to prevent water from passing to the contact areas between the electric wire and the positive and negative metal contact plates.

4 Claims, 5 Drawing Sheets

LAMP SOCKET WITH A WATER SEALING AND ELECTRIC LEAKAGE PREVENTING STRUCTURE

CROSS REFERENCE TO RELATED APPLICATION

This application is a Continuation-in-Part of U.S. patent application No. 08/638,495, filed Apr. 26, 1996, U.S. Pat. No. 5,743,757, which is a Continuation-in-Part of U.S. patent application No. 08/546,820, filed Oct. 23, 1995, U.S. Pat. No. 5,702,267, incorporated by reference herein.

BACKGROUND OF THE INVENTION

The present invention relates to lamp socket for Christmas tree light sets, and more specifically to such a lamp socket which has a water sealing and electric leakage preventing structure.

"UL" of the USA and "CSA" of Canada define strict specifications on electric lamp sockets. However, these specifications do not define any structure to protect lamp sockets against rain water. When a Christmas tree light set is installed outdoors, rain water may pass through gaps in lamp sockets, causing a short circuit, electric leakage, or electric shock.

SUMMARY OF THE INVENTION

The present invention has been accomplished to provide a lamp socket for Christmas tree light sets which eliminates the aforesaid problem. According to the present invention, a rubber gasket is fitted into the top wire groove of the socket body to hold the electric wire, and a rubber cover pad is covered on the rubber gasket over the electric wire. The rubber gasket has two slots for the passing of the positive metal contact plate and negative metal contact plate of the socket body, and two outwardly downwardly sloping top edges disposed at two opposite sides along the length. When the socket cap is fastened to the socket body, the rubber cover pad and the rubber gasket are compressed and closely wrapped on the periphery of the electric wire to seal the contact areas between the electric wire and the positive and negative metal contact plates.

DETAILED DESCRIPTION OF THE PREFERRED EMBODIMENT

Figure 1:
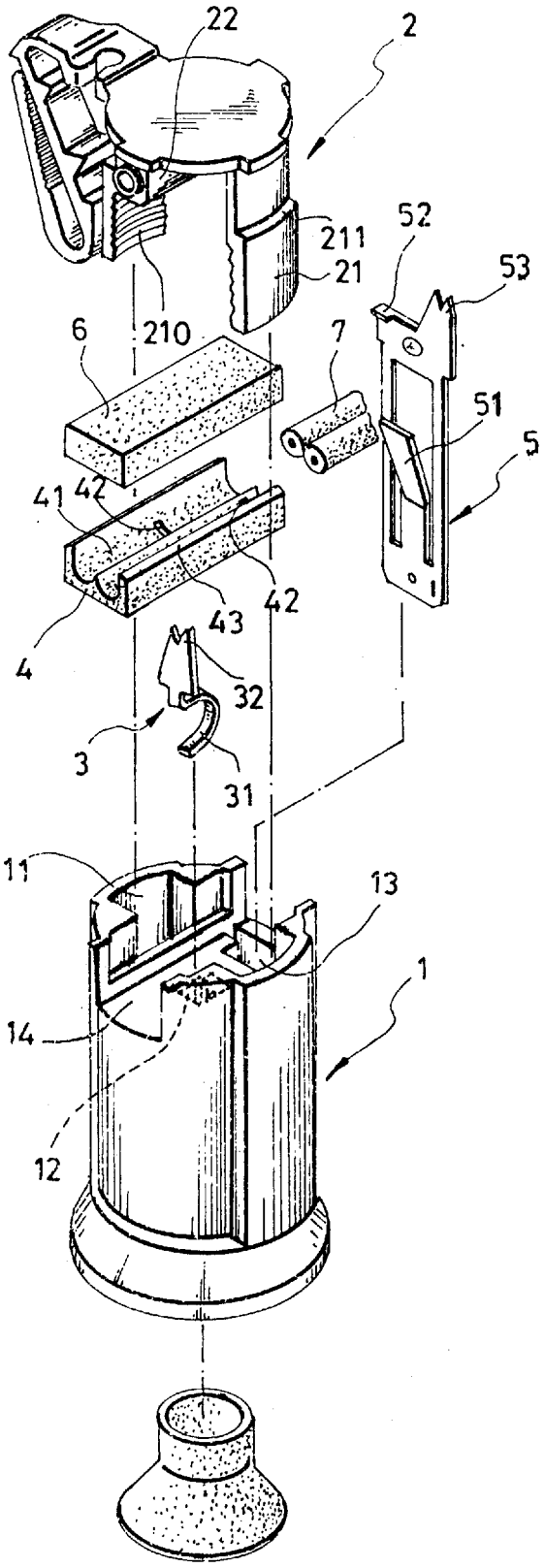
FIG. 1 is an exploded view of a lamp socket according to the present invention.
Figure 2:
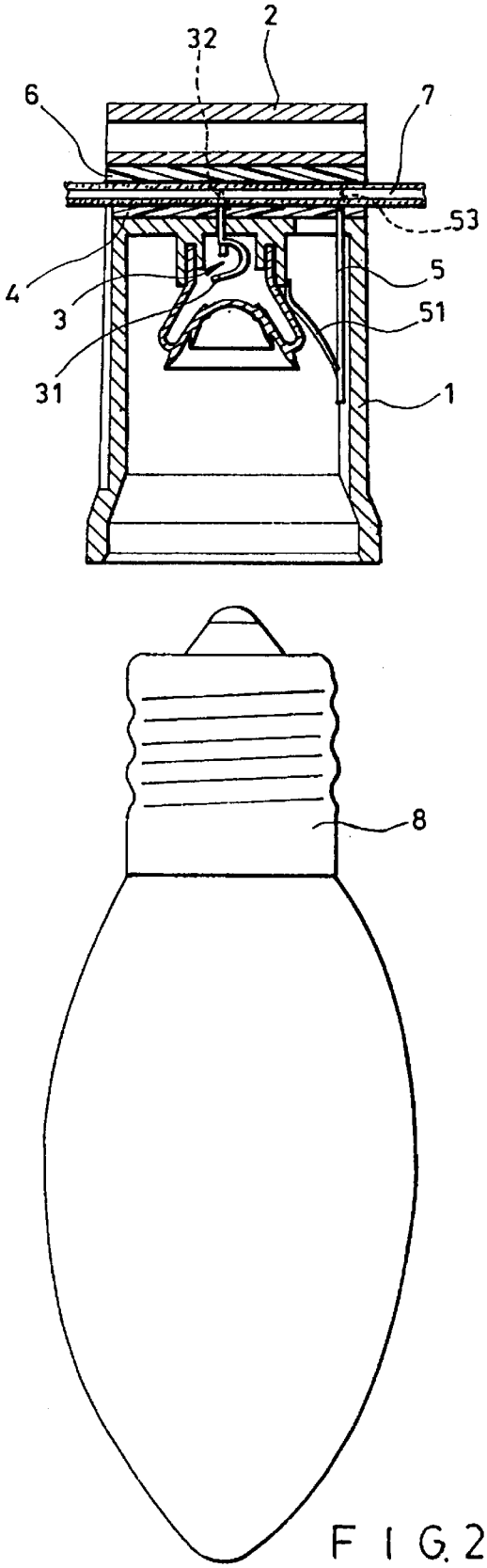
FIG. 2 is a sectional side view of the present invention, showing the lamp socket assembled.
Figure 3:
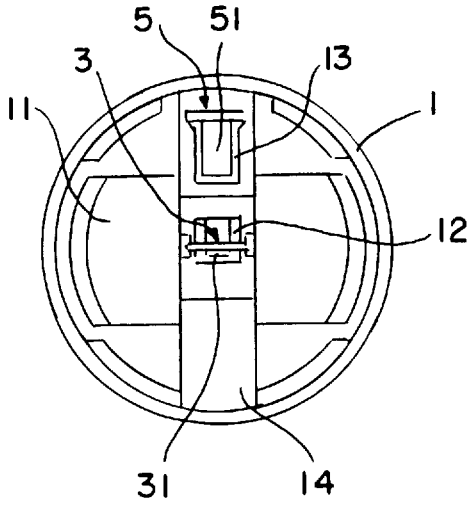
FIG. 3 is a top plain view of the socket body according to the present invention.

Referring to FIGS. from 1 to 3, the socket body, referenced by 1, comprises a wire groove 14 at the top which receives an electric wire 7, two retaining holes 11 disposed at two opposite sides of the wire groove 14, a center slot 12 extended from the center of the wire groove 14 to the inside space thereof, a positive metal contact plate 3 mounted in the center slot 12 which has a bottom end terminating in an arched springy contact tail 31 suspending inside the socket body and a top end terminating in a pointed tip 32 which is forced to pierce the insulator of the electric wire 7 and to make contact with one conductor therein, a side slot 13 near one end of the wire groove 14, a negative metal contact plate 5 mounted in the side slot 13 which has a unitary springy contact strip 51 upwardly inwardly raised from a bottom side thereof and suspending inside the socket body 1 and an inward locating strip 52 perpendicularly raised from the top and stopped above the side slot 13 to prevent the negative metal contact plate 5 from being downwardly pulled to deformed, and a pointed tip 53 which is forced to pierce the insulator of the electric wire 7 and to make contact with one conductor therein.

The socket cap, referenced by 2, comprises two downward plug plates 21 respectively inserted into the retaining holes 11 of the socket body 1, and a presser block 22 raised from the bottom side thereof in the middle between the downward plug plates 21 pressed on the electric wire 7. The downward plug plates 21 have threads 210 at an inner side adapted for engaging the ring contact of the base of the lamp bulb, referenced by 8, and a respective hooked portion 211 at an outer side forced into engagement with the retaining holes 11 at the bottom.

Figure 4:
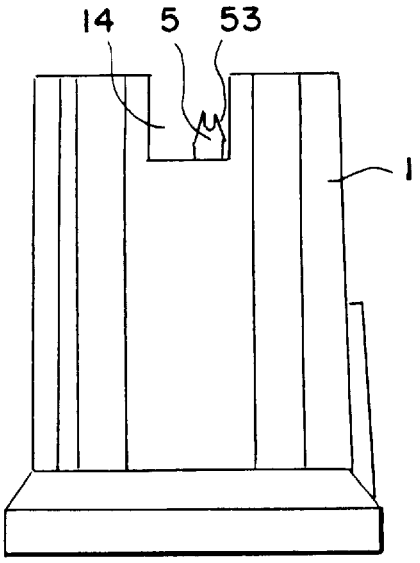
FIG. 4 is a side plain view of the socket body showing the pointed tip of the negative metal contact plate projecting into the wire groove according to the present invention.
Figure 5:
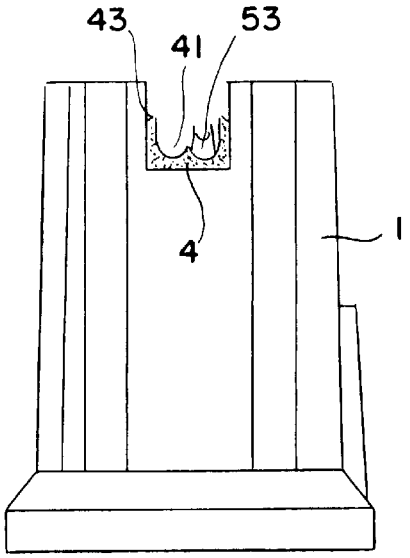
FIG. 5 is another side plain view of the socket body, showing the rubber gasket installed in the wire groove.
Figure 6:
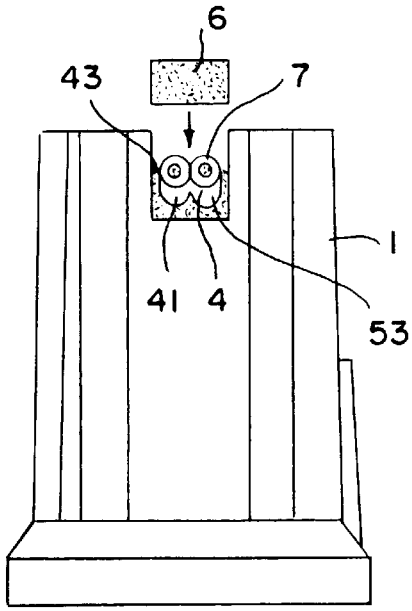
FIG. 6 is similar to FIG. 5 but showing the electric wire installed in the rubber gasket.
Figure 7:
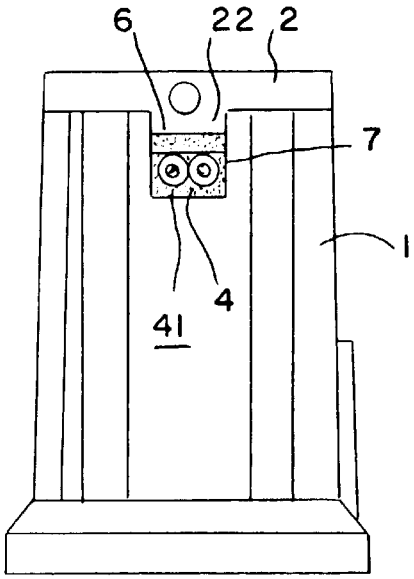
FIG. 7 is similar to FIG. 6 but showing the rubber cover pad covered on the rubber gasket over the electric wire and the socket cap fastened to the socket body.

Referring to FIGS. from 4 to 7 and FIG. 1 again, a rubber gasket 4 and a rubber cover pad 6 are mounted in the wire groove 14 and retained between the socket body 1 and the socket cap 2 to hold the electric wire 7 therebetween. The rubber gasket 4 fits the wire groove 14 in width and length, comprising two parallel grooves 41 longitudinally disposed at the top through the length which receive the electric wire 7, two slots 42 through which the pointed tips 32; 53 of the positive metal contact plate 3 and negative metal contact plate 5 pass respectively, and two outwardly downwardly sloping top edges 43 longitudinally disposed at two opposite sides along the length. When the positive metal contact plate 3 and the negative metal contact plate 5 are respectively mounted in the slots 12; 13 of the socket body 1 (see FIG. 4), the rubber gasket 4 is mounted in the wire groove 14 of the socket body 1, permitting the pointed tips 32; 53 of the metal contact plates 3; 5 to pass through the slots 42 (see FIG. 5), then the electric wire 7 is mounted in the grooves 41 of the rubber gasket 4 (see FIG. 6), and then the rubber cover pad 6 is covered on the rubber gasket 4 over the electric wire 7, and then the socket cap 2 is fastened to the socket body 1 by plugging the downward plug plates 21 of the socket cap 2 into the retaining holes 11 of the socket body 1, permitting the hooked portions 211 of the downward plug plates 21 to be respectively forced into engagement with the periphery of the retaining holes 11 of the socket body 1. When the socket cap 2 is installed, the two opposite lateral side walls of the rubber gasket 4 are compressed, thereby causing the sloping top edges 43 to tilt inwards from an outwardly downwardly disposed position to a horizontal position, and the rubber cover pad 6 is forced by the presser block 22 of the socket cap 2 to tightly cover over the sloping top edges 43 of the rubber gasket 4, and therefore the electric wire 7 is firmly wrapped within the rubber gasket 4 and the rubber cover pad 6 (see FIG. 7). At the same time, the downward pressure of the socket cap 2 forces the pointed tips 32; 53 of the metal contact plates 3; 5 to pierce the insulator of the electric wire 7 and to make contact with a respective conductor in the electric wire 7.

Figure 8:
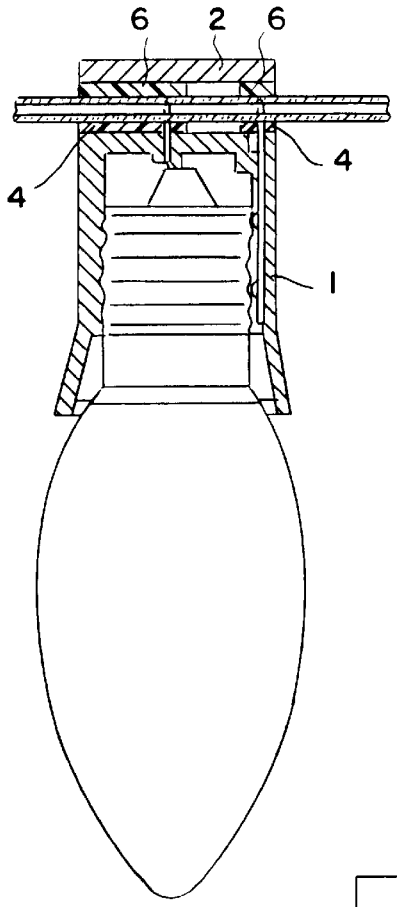
FIG. 8 is a sectional side view of an alternate form of the present invention.

FIG. 8 shows an alternate form of the present invention, in which two rubber gaskets 4 and two rubber cover pads 6 are mounted between the socket body 1 and the socket cap 2 at locations corresponding to the positive metal contact plate 3 and the negative metal contact plate 5 respectively. This arrangement diminishes the consumption of rubber material. The structures and functions of the two rubber gaskets 4 and rubber cover pads 6 are same as the rubber gasket and rubber cover pad shown in FIGS. from 1 to 7.

Figure 9:
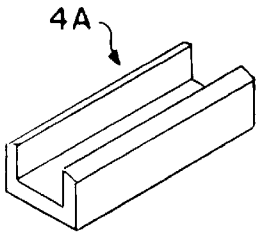
FIG. 9 is an elevational view of an alternate form of the rubber gasket according to the present invention.
Figure 10:
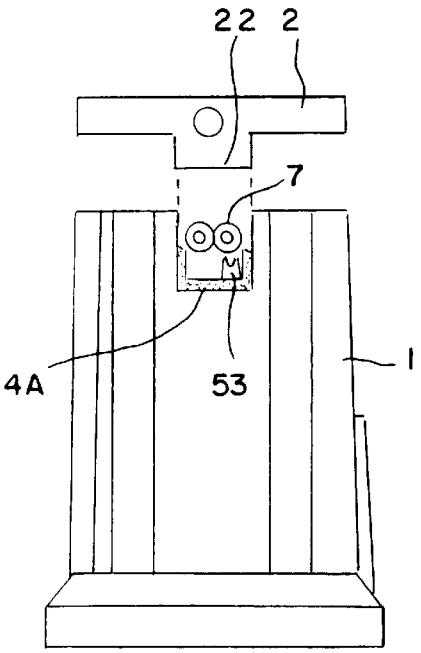
FIG. 10 is a side view showing the channel-like rubber gasket of FIG. 9 installed in the wire groove of the socket body according to the present invention.
Figure 11:
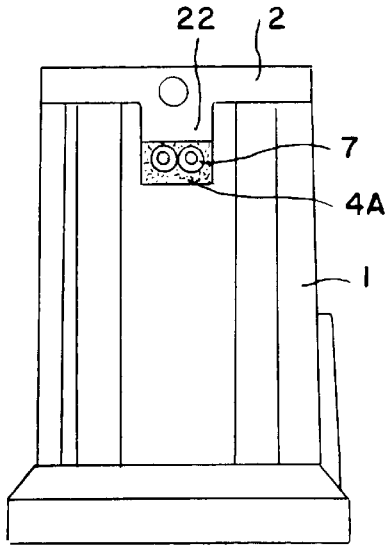
FIG. 11 is similar to FIG. 10 but showing the socket cap fastened to the socket body.

FIG. 9 shows an alternate form of the rubber gasket. According to this alternate form, the rubber gasket 4A is shaped like a channel bar having a smooth inside wall. When the socket cap 2 is fastened to the socket body 1, the rubber gasket 4A is forced to deform and to tightly fit over the curved periphery of the electric wire 7, and the topmost edges of the two upward lateral walls of the rubber gasket 4A are forced into close contact with the periphery of the presser block 22 of the socket cap 2 (see FIGS. 10 and 11).

It is to be understood that the drawings are designed for purposes of illustration only, and are not intended as a definition of the limits and scope of the invention disclosed.

What the invention claimed is:

1. A lamp socket of the type comprising a socket body having a top wire groove and two slots in said top wire groove and holding a positive metal contact plate and a negative metal contact plate in said slots, a socket cap fastened to said socket body to hold down an electric wire in the top wire groove of said socket body and to force said positive metal contact plate and said negative metal contact plate into electric contact with a respective conductor in said electric wire, wherein a rubber gasket and a rubber cover pad are mounted within the top wire groove of said socket body and compressed between said socket body and said socket cap to hold said electric wire therebetween, said rubber cover pad being covered on said rubber gasket over said electric wire, said rubber gasket fitting over the top wire groove of said socket body and having two slots through which said positive metal contact plate and said negative metal contact plate pass and two sloping top edges longitudinally disposed at two opposite sides along the length, the two sloping edges sloping from an inner edge to an outer edge, the inner edge being closer to the socket cap than the outer edge is to the socket cap, the two sloping edges respectively inwardly forced into close contact with said rubber cover pad, said electric wire being firmly wrapped within the rubber gasket and cover pad.

2. The lamp socket of claim 1 wherein said rubber gasket and said rubber pad are respectively comprised of two separate halves respectively disposed at locations corresponding to the two slots of said rubber gasket.

3. The lamp socket of claim 1 wherein said rubber gasket comprises two parallel grooves longitudinally disposed at a top side thereof along the length and fitting over the periphery of said electric wire at a bottom side.

4. The lamp socket of claim 1 wherein said rubber gasket is shaped like a channel bar having a smooth inside wall.

* * * * *